US006079560A

United States Patent [19]

Champion

[11] Patent Number: 6,079,560

[45] Date of Patent: Jun. 27, 2000

[54] PALLET AND BIN WRAP

[76] Inventor: Robert D. Champion, P.O. Box 461689, Escondido, Calif. 92030

[21] Appl. No.: 09/436,100

[22] Filed: Nov. 8, 1999

Related U.S. Application Data

[63] Continuation of application No. 08/966,173, Nov. 7, 1997, abandoned.

[51] Int. Cl.[7] ..... B65D 19/20

[52] U.S. Cl. ..... 206/386; 206/600

[58] Field of Search ..... 206/386, 595, 206/596–600, 459.5; 229/122.33, 199.1; 108/51.3, 56.1, 56.3

[56] References Cited

U.S. PATENT DOCUMENTS

| | | | |
|---|---|---|---|
| 3,204,385 | 9/1965 | DeRemer et al. | 206/386 |
| 3,995,736 | 12/1976 | Lawson et al. | 206/386 |
| 4,013,168 | 3/1977 | Bamburg et al. | 206/386 |
| 4,019,635 | 4/1977 | Boots | 206/386 |
| 4,296,860 | 10/1981 | Hsu et al. | 206/386 |
| 4,868,955 | 9/1989 | Magnant et al. | 206/597 |
| 5,110,037 | 5/1992 | Pieritz, Sr. | 206/386 |
| 5,918,744 | 7/1999 | Bringard et al. | 206/596 |

*Primary Examiner*—Paul T. Sewell
*Assistant Examiner*—Luan K. Bui
*Attorney, Agent, or Firm*—Parsons & Goltry; Robert A. Parsons; Michael W. Goltry

[57] ABSTRACT

A storage assembly comprising a pallet, a bin including a continuous sidewall bounding a chamber for holding storage items therein and an elongate cover wrappingly and detachably engagable about the pallet and the continuous sidewall of the bin and generally coextensive therewith for substantially concealing the pallet and the continuous sidewall of the bin.

13 Claims, 2 Drawing Sheets

FIG. 1
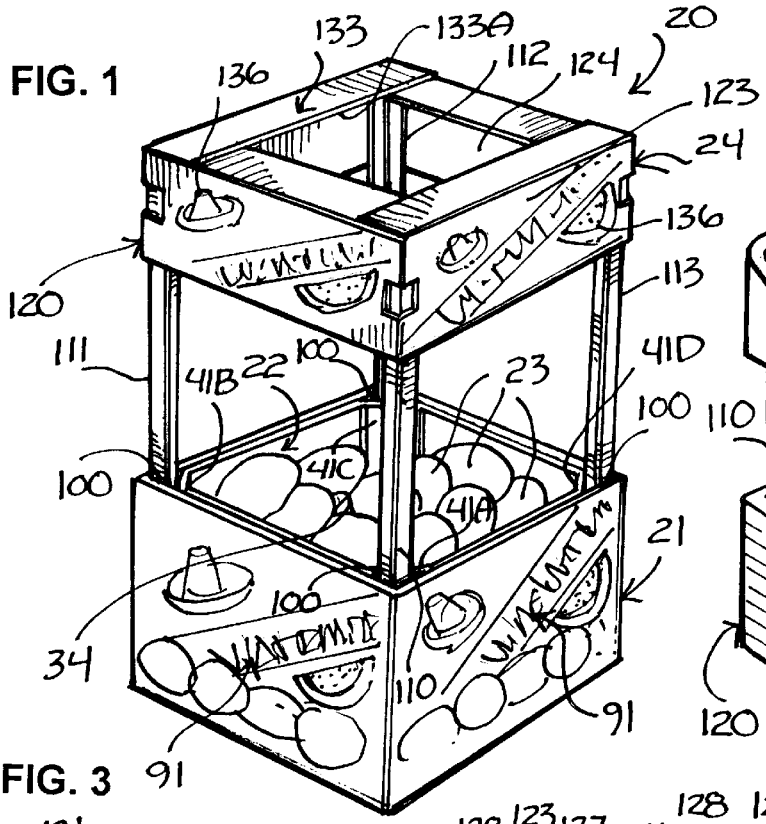
FIG. 2
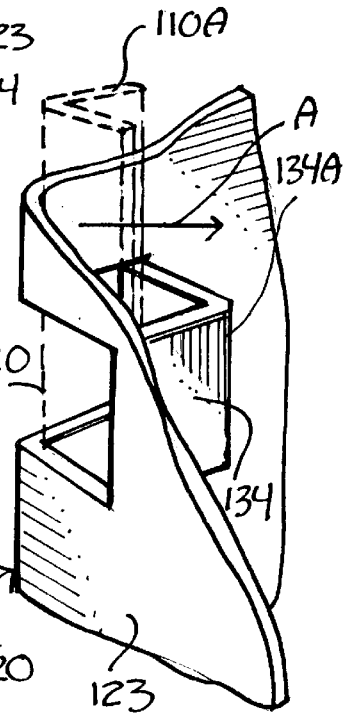
FIG. 3
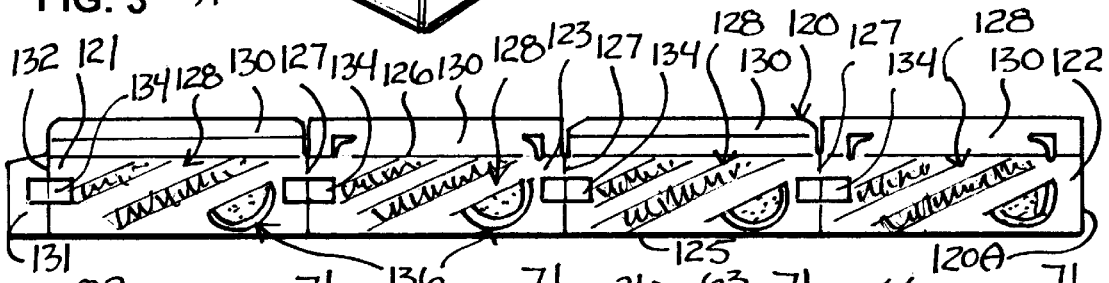
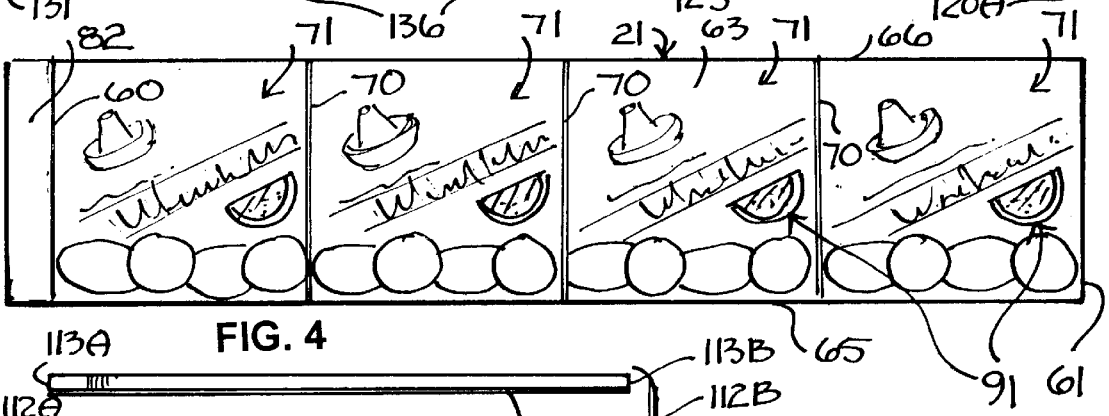
FIG. 4
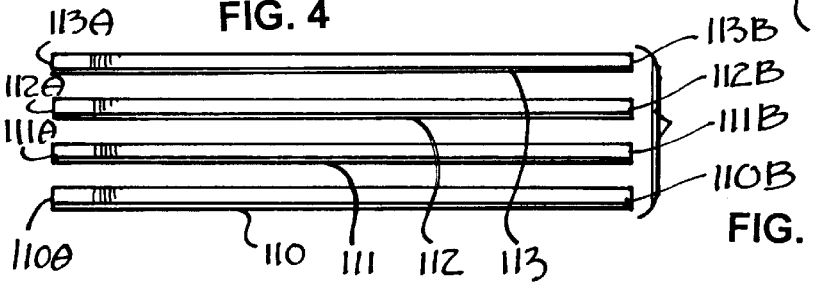
FIG. 5

FIG. 6
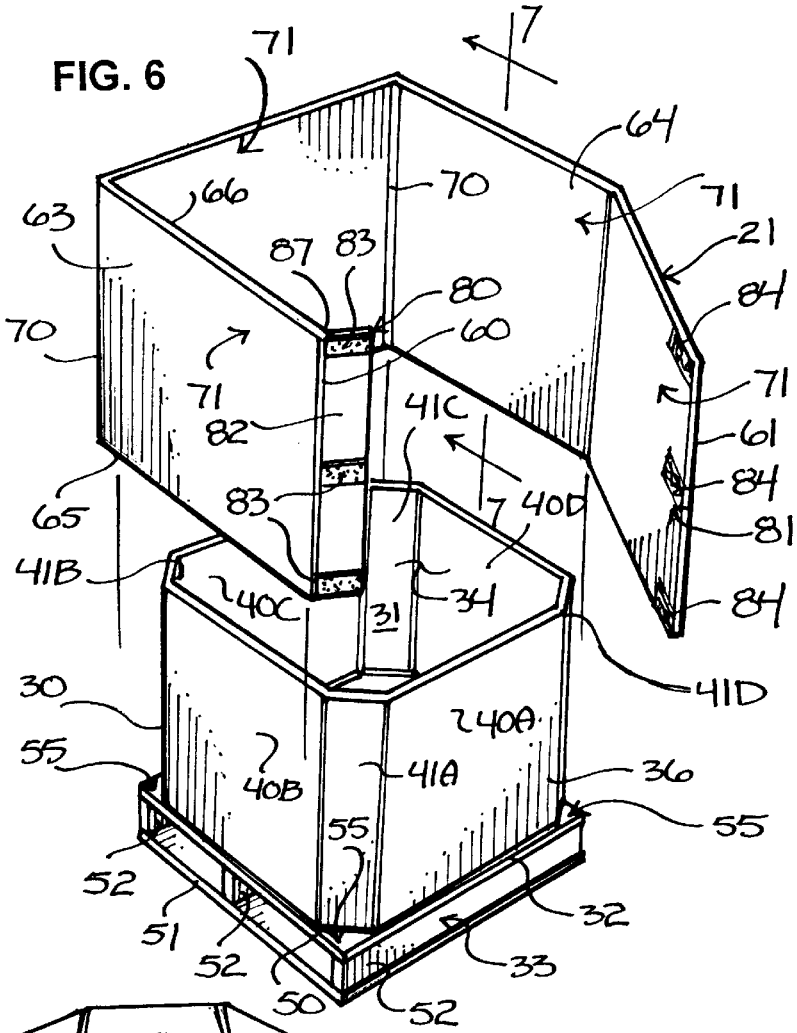
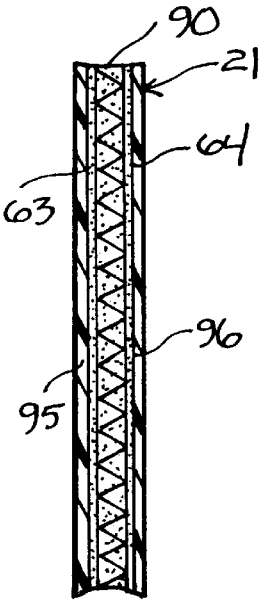
FIG. 7
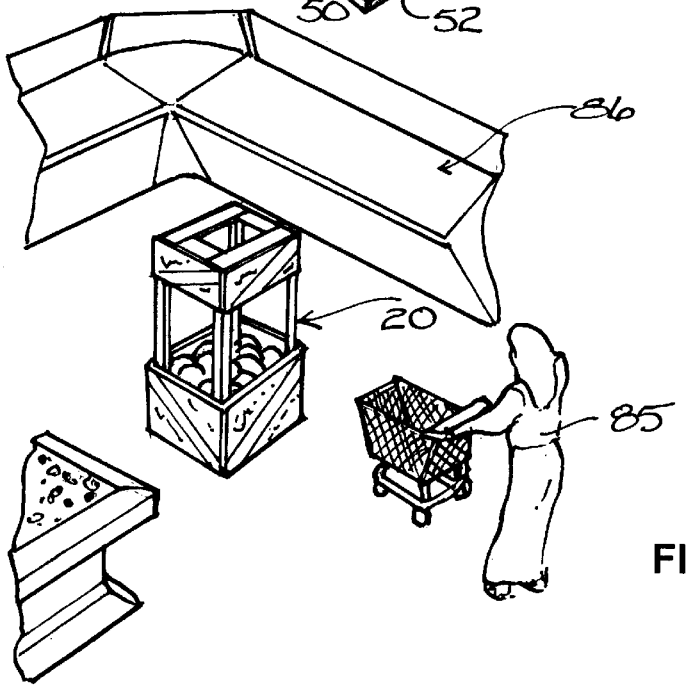
FIG. 8

PALLET AND BIN WRAP

This application is a continuation application of application Ser. No. 08/966,173, filed Nov. 7, 1997, now abandoned.

BACKGROUND OF THE INVENTION

1. Field of the Invention

This invention relates generally to the field of storage containers.

More particularly, this invention relates to retail and warehouse store storage containers for holding and presenting large items and of a type having a bin carried by a pallet.

In a further and more specific aspect, the instant invention relates to a cover for a retail and warehouse store storage container of a type having a bin carried by a pallet for preventing shoppers from stumbling over exposed portions of the pallet.

2. Prior Art

Shipping and storage bins are common items normally used to ship and present large items such as watermelons, pumpkins, squash, toys, pet toys and other similarly large items to customers. These storage bins are typically octagonal and carried by a pallet, and are commonly found in grocery stores, pet stores and department stores. Although exemplary for holding large items for shipping large items and for presenting the items to customers, they are unattractive and the normally octagonal shape of the bins result in the corners of the pallet extending outward from the bin. This can be a hazard, because shoppers focus on the bin and not the pallet which can result in shoppers tripping over the corners of the pallet and perhaps stubbing their toes on the corners of the pallet. Accordingly, these and other deficiencies in the prior art necessitate certain new and useful improvements operative for making the shipping and storage bins of the foregoing variety more attractive and safe for shoppers.

It would be highly advantageous, therefore, to remedy the foregoing and other deficiencies inherent in the prior art.

Accordingly, it is an object of the present invention to provide a cover for wrapping engagement about a storage assembly of a type having a bin supported upon a pallet for concealing exposed portions of the pallet and for making the storage assembly more attractive.

Another object of the present invention is to provide a cover that is easy to construct.

And another object of the present invention is to provide a cover that is inexpensive.

Still another object of the present invention is to provide a cover that is easy to use.

Yet another object of the instant invention is to provide a cover including visual surfaces suitable for supporting selected indicia including, for instance, advertising media.

Yet still another object of the instant invention is the provision of enhancing customer safety.

And a further object of the invention is to provide a cover that may be easily cleaned.

Still a further object of the immediate invention is to provide a cover that may be reused.

Yet a further object of the invention is the provision of decreasing the amount of needless injuries that customers and others may sustain when walking around or near storage assemblies of the type having a bin carried by a pallet.

And still a further object of the invention is to provide a cover that is convenient to use.

And yet another object of the invention is to provide a cover that prevents insects from accessing a storage assembly.

SUMMARY OF THE INVENTION

Briefly, to achieve the desired objects of the instant invention in accordance with a preferred embodiment thereof, provided is a storage assembly comprising a pallet and a bin carried by the pallet for supporting the bin above a surface, the bin including a continuous sidewall bounding a chamber for holding storage items therein and including a closed end positionable upon the pallet, an open end and a continuous outer surface. Further included is a cover having an outer surface, an inner surface, a first end and a second end, the cover adapted for wrapping engagement about the pallet and the continuous sidewall of the bin in a wrapped orientation for substantially concealing the pallet and the continuous outer surface of the continuous sidewall of the bin. An engagement assembly may also be provided operative for detachably engaging the first end of the cover with the second end of the cover when the cover is disposed in the wrapped orientation about the pallet and the bin.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 1 illustrates a storage assembly including a cover for wrapping engagement about a bin of a type used for holding and displaying large items and a head cover supported above the bin by virtue of plurality of elongate support elements extending upwardly from the bin, in accordance with a preferred embodiment of the present invention;

FIG. 2 is a fragmented perspective view of a corner of the head cover of FIG. 1 further illustrating, in dotted outline, one of the plurality of support elements extending through a sleeve of the head cover;

FIG. 3 illustrates a front elevational view of the head cover of FIG. 1 shown as it would appear in an extended orientation;

FIG. 4 illustrates a front elevational view of the cover of FIG. 1 shown as it would appear in an extended orientation;

FIG. 5 illustrates a front elevational view of the plurality of elongate support elements first shown in combination with FIG. 1;

FIG. 6 is a perspective view of a bin carried upon a pallet and the cover of FIG. 1 shown spaced from the bin and the pallet as it would appear prior to wrapping engagement about the bin and the pallet;

FIG. 7 is a sectional view taken along line 7—7 of FIG. 6; and

FIG. 8 is a perspective view of the storage assembly of FIG. 1 shown as it would appear in a grocery store.

DETAILED DESCRIPTION OF THE PREFERRED EMBODIMENT

Turning now to the drawings, in which like reference characters indicate corresponding elements throughout the several views, attention is first directed to FIG. 1 which illustrates a storage assembly generally designated by the reference character 20. Storage assembly includes a cover 21 for wrapping engagement about a bin 22 of a type used for holding and displaying storage items 23 and a head cover 24 supported above bin 22 by virtue of plurality of elongate support elements 110, 111, 112 and 113 extending upwardly from bin 22, in accordance with a preferred embodiment of the present invention.

With momentary reference to FIG. 6, bin 22 of the present invention is of a conventional variety commonly used for shipping and presenting goods such as produce, toys and pet supplies to customers, for instance, in grocery stores, department stores and pet stores. In this regard, bin 22, of which may be constructed of corrugated paper, plastic or other common or suitable material, includes a continuous sidewall 30 bounding a chamber 31 for holding storage items 23 therein and including a closed end 32 positionable upon a pallet 33, an open end 34, a continuous inner surface 35 and a continuous outer surface 36. Typical with conventional bins of the foregoing variety, continuous sidewall 30 is formed generally in the shape of an octagon having four major panels 40A, 40B, 40C and 40D and four minor panels 41A, 41B, 41C and 41D all of which cooperate together to define continuous sidewall 30. Consistent with typical bins, four major panels 40A, 40B, 40C and 40D define the major sidewalls of continuous sidewall 30 and four minor panels 41A, 41B, 41C and 41D define the corners of continuous sidewall 30.

Pallet 33 is of a conventional variety well known to those having regard to the art. As herein previous intimated, closed end 32 of bin 22 may be placed upon pallet 33 for supporting bin 22 above a surface. Typical with conventional pallets used for shipping, pallet 33, of which may be constructed of wood or other similar substance consistent with know pallet construction, may be provided having a generally square or rectangular shape having four corners and may further include an upper panel 50, a lower panel 51 spaced and generally parallel to upper panel 50 and a plurality of equally spaced-apart upright support members 52 interconnecting upper panel 50 with lower panel 51. Because pallet 33 is a well known item to those having ordinary skill, further details of pallet 33 will not be herein further discussed as they will be readily apparent and understood. Furthermore, other common pallet designs may certainly be used in combination with the present invention without departing from the nature and scope of the present invention as herein specifically disclosed.

As can be seen in FIG. 6, when bin 22 is positioned upon and carried by pallet 33, the each of the corners of pallet 33 will be typically aligned with a one of the four minor panels 41A, 41B, 41C and 41D of bin 22. Due to the typical octagonal shape of bin 22, each corner of pallet 33 will typically extend outwardly from a corresponding one of the four minor panels 41A, 41B, 41C and 41D proximate closed end 32 of bin 22 thereby defining four exposed portions (only three of which are shown in FIG. 6) of pallet 33 each being generally designated by the reference character 55.

With continuing reference to FIG. 6 and additional reference to FIG. 4 illustrating a front elevational view of cover 21, cover 21 is generally elongate, substantially planar and includes a first end 60, a second end 61, an outer surface 63, an inner surface 64 (not shown in FIG. 4), a first edge 65 and a second edge 66. Consistent with the advantageous teachings of the present invention, cover 21 is suitably adapted for wrapping engagement about pallet 33 and continuous sidewall 30 of bin 22 substantially coextensive therewith in a wrapped orientation for substantially concealing pallet 33 and continuous outer surface 36 of continuous sidewall 30. Consistent with the foregoing, cover 21 is suitably provided with a plurality of fold aspects 70 formed therealong cover 21 in spaced-apart relation, each one of the plurality of fold aspects 70 extending from first edge 65 to second edge 66 and segmenting cover 21 into a plurality of cover panel sections each designated by the reference character 71 and of which in the specific example shown in FIGS. 4 and 7 amount to four. In this manner, and as shown in FIG. 4, a user may fold cover 21 inwardly at fold aspects 70 and then desirably wrappingly engage cover 21 about pallet 33 and bin 22 in a wrapped orientation to substantially conceal pallet 33 and bin 22 along substantially the entire extent thereof from pallet 33 to open end 34 of bin 22 as clearly shown in FIG. 1. It will be generally understood from the present discussion that cover 21 may include various fold aspects 70 suitable for adapting cover 21 to wrappingly engage a bin and a pallet of varying size and shape consistent with the teachings herein.

To secure cover 21 to pallet 33 and bin 22 in the wrapped orientation as shown in FIG. 1, cover 21 may be provided with an engagement assembly operative for detachably engaging first end 60 of cover 21 with second end 61 of cover when disposed in the wrapped orientation. As shown in FIG. 4, the preferred engagement assembly of the present invention includes an engagement element 80 carried by first end 60 of cover 21, and an opposing complemental engagement element 81 carried by second end 61 of cover 21. Although a variety of mechanical engagement mechanisms may be used for detachably engaging first end 60 with second end 61, first engagement element 80 includes a flap 82 extending outwardly from first end 60 and having a plurality of VELCRO® engagement loop fasteners 83 fixed thereto. Furthermore, second engagement element 81 includes a plurality of opposing VELCRO® complemental hook fasteners 84 fixed thereto and each operative for detachably engaging a one of the plurality of VELCRO® loop fasteners. A fold aspect 87 interconnects flap 82 with first end 60 of cover 21 for allowing a user to desirably fold flap as needed to facilitate engagement of flap 82 to second end 61 of cover 21 in the manner previously described. To disengage cover 21 from bin 22 and pallet 33 in order to advantageously reuse or store cover 21, one need only reverse the foregoing operation.

As previously intimated, upon wrapping engagement of cover 21 to bin 22 and pallet 33, continuous sidewall of bin 22, pallet 33 and exposed portions 55 of pallet are substantially concealed by cover 21 along substantially the entire extent of pallet 33 and continuous sidewall 30 of bin 22. In this regard, and as shown in FIG. 8, with exposed portions 55 concealed by cover 21, a user 85 shopping in a store 86, such as a grocery store or the like, will be prevented from tripping over or perhaps stubbing their toes against exposed portions 55 of pallet 33 thereby desirably eliminating the risk of personal injury to user 85.

With momentary attention to FIG. 7 illustrating a sectional view of cover 21 taken along line 7—7 of FIG. 6, cover 21 is preferably constructed of a corrugated panel 90 constructed of paper, plastic or other suitable material and having outer surface 63 and inner surface 64. Furthermore, to enhance the visual appearance of cover 21, outer surface 63 of corrugated panel 90 of cover 21 may be provided with selected indicia 91 (shown in FIGS. 1 and 4) such as selected commercial advertisements, selected artwork, indicia operative for indicating the contents of bin 22 or other form of indicia that may be visually perceived and understood preferably operative for either disseminating information to onlookers or otherwise operative for evoking a pleasing response to onlookers.

Consistent with the advantageous teachings of the present invention, and with continuing reference to FIG. 7, corrugated panel 90 may include a first protective layer 95 fixed to outer surface 63 thereof and a second protective layer 96 fixed to inner surface 64 thereof and operative for not only protecting indicia 91 but also operative for preventing outer surface 63 and inner surface 64 of cover 21 from becoming damaged, mired or soiled as a result of contact with food or other items. In this regard, first and second protective layers 95 and 96 are preferably comprised of clear plastic material or the like laminated or otherwise affixed to outer surface 63 and inner surface 64, respectively, of cover 21 and of which may be easily cleaned by a user when needed. First and second protective layers 95 and 96 may each alternatively be comprised of wax layer if desired.

With attention directed back to FIG. 1, upon installation of cover 21, cover 21 and four minor panels 41A, 41B, 41C and 41D directly adjacent inner surface 64 (not shown in FIG. 1) of cover 21 cooperate together to define a plurality of gaps 100 corresponding to exposed portions 55 (not shown in FIG. 1) of the pallet 33 (not shown in FIG. 1) and extending upwardly therefrom exposed portions 55 and terminating at open end 34 of bin 22. As shown in FIG. 5, a plurality of elongate support elements 110, 111, 112 and 113 may be provided each having a first end 110A, 111A, 112A and 113A and a second end 110B, 111B, 112B and 113B, respectively. Preferably constructed of a selected type of metal, wood, plastic or other substance having similar structural and function characteristics, first end 110A, 111A, 112A and 113A (not shown in FIG. 1) of each respective elongate support element 110, 111, 112 and 113 may each be inserted into and through a one of the plurality of gaps 100 for receipt against a corresponding one of the plurality of exposed portions 55 of pallet 33, each elongate support element 110, 111, 112 and 113 extending therethrough a corresponding gap 100 and terminating with second end 110B, 111B, 112B and 113B (not shown in FIG. 1) at a point superjacent open end 34 of bin 22. A head cover 120 may then be mounted to second ends 110B, 111B, 112B and 113B of elongate support elements 110, 111, 112 and 113 operative as a decorative element and as a mechanism for carrying indicia observable by onlookers.

With attention directed to FIG. 3 illustrating a front elevational view of head cover 120, head cover 120 includes a generally elongate and substantially planar sidewall 120A having a first end 121, a second end 122, an outer surface 123, an inner surface 124 (shown only in FIG. 1), a lower edge 125 and an upper edge 126. Consistent with the advantageous teachings of the present invention, head cover 120 is suitably adapted for wrapping engagement about second ends 110B, 111B, 112B and 113B of elongate support members 110, 111, 112 and 113 in a wrapped orientation much like cover 21. Consistent with the foregoing, head cover 120 is suitably provided with a plurality of fold aspects 127 formed therealong in spaced-apart relation, each one of the plurality of fold aspects 127 extending from lower edge 125 to upper edge 126 and segmenting head cover 120 into a plurality of head cover panel sections each designated by the reference character 128 and of which in the specific example shown in FIGS. 1 and 3 amount to four.

In this specific example, head cover 120 further includes a plurality of elongate flaps 130 extending upwardly from upper edge 126 in series and each corresponding to a one of the plurality of head cover panel sections 128. Head cover 120 also includes an auxiliary flap 131 connected to and extending outwardly from first end 121 by virtue of a fold aspect 132. Also provided are brace elements 134 formed into head cover 120 at folded aspects 127 and 133.

In this manner of construction, a user may fold head cover 120 inwardly toward inner surface 124 at fold aspects 127 and engage auxiliary flap 131 to second end 122 to form a continuous sidewall, and correspondingly fold elongate flaps 130 inwardly upon each other and engage them together to form an inwardly extending annular flange generally designated by the reference character 133 in FIG. 1 and extending inwardly therefrom and terminating with an inward edge 133A. As seen in FIG. 2, upon the folding of head cover 120 along fold aspects 127 in the foregoing manner, each brace element 134 will fold and extend inwardly in the direction indicated by the arrowed line A away from outer surface 123 to form a bracket 134A. Like the prior teachings regarding cover 21, head cover 120 may be provided with a suitable engagement assembly carried at auxiliary flap 131 and second end 122 of head cover 120 operative for detachably engaging first end 121 of head cover to second end 122 of head cover. Furthermore, elongate flaps 130 may be engaged together to form inwardly extending annular flange by virtue of a selected adhesive, a selected detachably engagable engagement assembly or other suitable mechanical engagement mechanism.

To position and secure head cover 120 upon second ends 110B, 111B, 112B and 113B of elongate support elements 110, 111, 112 and 113, a user may insert second ends 110B, 111B, 112B and 113B into and through each respective bracket 134A for supporting receipt against inwardly extending annular flange 133. As can be seen in FIG. 2 for the purposes of illustration, shown is second end 110B of elongate support element 110 extending into and through a corresponding bracket 134A. In this regard, brackets 134A operate to detachably secure head cover 120 to second ends 110B, 111B, 112B and 113B in spaced relation from open end 34 of bin 22. As shown in FIG. 1 and FIG. 3, outer surface 123 of head cover 120 may be provided with indicia 136 much like indicia 91 discussed in combination with cover 21.

The present invention has been described above with reference to a preferred embodiment. However, those skilled in the art will recognize that changes and modifications may be made in the described embodiments without departing from the nature and scope of the present invention. For instance, first and second edges 65 and 66 of cover 21 may be provided with pressure sensitive or heat activated tape for sealing first and second edges 65 and 66 with bin 22 for preventing insects from accessing cover 21 and the contents of bin 22. Furthermore, cover 21 may be constructed of varying sizes for not only wrapping a single bin 22, but also a plurality of bins if desired. Furthermore, a plurality of covers 21 may also be coupled together in series if desired for wrapping either a very large bin or a plurality of bins arranged in series.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A storage assembly, comprising:

a generally planar pallet having four corners;

a bin carried by the pallet, the bin including a continuous generally octagonal sidewall bounding a chamber for holding storage items therein and including a closed end positioned upon the pallet, an open end and a continuous outer surface, the four corners of the pallet extending outwardly past the sidewall;

a cover having an outer surface, an inner surface, a first end and a second end, the cover wrapped about the pallet and the continuous sidewall of the bin covering the pallet, including the four corners, and the continuous outer surface of the continuous sidewall of the bin; and an engagement element coupled to the first end of the cover and a complimental engagement element coupled to the second end of the cover detachably engaging the first end of the cover with the second end of the cover to enclose the pallet and the continuous sidewall.

2. The storage assembly of claim 1, wherein the cover further includes a plurality of folds formed along a length thereof at spaced intervals, the folds allowing a user to selectively fold the cover for disposing the cover about the pallet and the continuous sidewall of the bin.

3. The storage assembly of claim 1, further including indicia carried by the outer surface of the cover and visible with the cover wrapped about the pallet and the continuous sidewall of the bin.

4. The storage assembly of claim 1, wherein the cover further includes a first protective layer carried by the outer surface of the cover for protecting the outer surface of the cover from becoming mired and permitting cleaning.

5. The storage assembly of claim 1, wherein the cover further includes a second protective layer carried by the inner surface of the cover for protecting the inner surface of the cover from becoming mired and permitting cleaning.

6. A storage assembly, comprising:

a pallet;

a bin carried by the pallet, the bin including a continuous sidewall bounding a chamber for holding storage items therein and including a closed end positioned upon the pallet, an open end and a continuous outer surface, wherein portions of the pallet extend outwardly beyond the closed lower end of the bin thereby forming a plurality of exposed pallet portions;

a cover having an outer surface, an inner surface, a first end and a second end, the cover wrapped about the pallet and the continuous sidewall of the bin encircling and substantially concealing the pallet and the continuous outer surface of the continuous sidewall of the bin, a plurality of gaps defined by the cover and the bin, the gaps corresponding to the plurality of exposed pallet portions and extending upwardly from the pallet and terminating at the open end of the bin; and an engagement element coupled to the first end of the cover and a complimental engagement element coupled to the second end of the cover detachably engaging the first end of the cover with the second end of the cover to enclose the pallet and the continuous sidewall.

7. The storage assembly of claim 6, wherein the cover further includes a plurality of folds formed along the length thereof in spaced-apart relation, the folds allowing a user to selectively fold the cover about the pallet and the continuous sidewall of the bin.

8. The storage assembly of claim 6, further including indicia carried by the outer surface of the cover and visible with the cover wrapped about the pallet and the continuous sidewall of the bin.

9. The storage assembly of claim 6, wherein the cover further includes a first protective layer carried by the outer surface of the cover for protecting the outer surface of the cover from becoming mired and permitting cleaning.

10. The storage assembly of claim 6, wherein the cover further includes a second protective layer carried by the inner surface of the cover for protecting the inner surface of the cover from becoming mired and permitting cleaning.

11. The storage assembly of claim 6, further including:

a plurality of support elements each having a first end received by one of the plurality of gaps against a corresponding one of the plurality of exposed pallet portions and extending through the one of the plurality of gaps from the corresponding one of the plurality of exposed pallet portions and terminating with a second end at a point superjacent the open end of the bin; and a head cover carried by the upper ends of the plurality of support elements.

12. The storage assembly of claim 11, wherein the head cover includes a continuous sidewall having an open lower end an upper edge having an annular flange extending inwardly therefrom and terminating with an inward edge, the continuous sidewall placed upon the second ends of the plurality of support elements for supporting receipt against the annular flange.

13. The storage assembly of claim 12, wherein the continuous sidewall further includes a plurality of fold aspects formed along the length thereof in spaced-apart relation, folded about the second ends of the plurality of support elements.

* * * * *